US005922986A

United States Patent [19]

Wanninger et al.

[11] Patent Number: 5,922,986

[45] Date of Patent: Jul. 13, 1999

[54] ARMOR PLATE FOR VEHICLES

[75] Inventors: Paul Wanninger, Schrobenhausen; Jürgen Kruse, Ganderkesee, both of Germany

[73] Assignee: Daimler-Benz Aerospace AG, München, Germany

[21] Appl. No.: 07/199,364

[22] Filed: May 13, 1988

[30] Foreign Application Priority Data

May 15, 1987 [DE] Germany ..... 3716291

[51] Int. Cl.[6] ..... F41H 5/007; F41H 3/00

[52] U.S. Cl. ..... 89/36.17; 89/36.02; 342/3

[58] Field of Search ..... 89/36.17, 36.02; 342/1, 2, 3

[56] References Cited

U.S. PATENT DOCUMENTS

| | | | |
|---|---|---|---|
| 3,130,414 | 4/1964 | Bailey et al. | 89/36.02 |
| 3,454,947 | 7/1969 | Wesch et al. | 89/36.02 |
| 3,599,210 | 8/1971 | Stander | 343/18.1 |
| 4,006,479 | 2/1977 | LaCombe | 342/1 |
| 4,024,318 | 5/1977 | Forster et al. | 342/1 |
| 4,368,660 | 1/1983 | Held | 89/36.17 |
| 4,497,253 | 2/1985 | Sabranski | 89/36.17 |
| 4,606,848 | 8/1986 | Bond | 343/18.1 |
| 4,699,741 | 10/1987 | Back et al. | 149/11 |

*Primary Examiner*—Stephen M. Johnson
*Attorney, Agent, or Firm*—McGlew and Tuttle

[57] ABSTRACT

An armor plating for vehicles has at its outer side a layer (13) of plastics material bound explosive containing radar absorbing materials.

10 Claims, 1 Drawing Sheet

ARMOR PLATE FOR VEHICLES

BACKGROUND OF THE INVENTION

The invention is directed to vehicle armor plate.

So-called active armor is already known which consists of a thin outer layer from inert material, thus, for instance, a thin steel plate, the main armor of the vehicle and an explosive material layer between the thin steel plate and the main armor. This armor is designed against shaped charges. The explosive material layer is made to detonate by the shaped charge spike, whereby the thin steel plate moves away from the main armor obliquely to the trajectory of the shaped charge spike, if the shaped charge spike does not impact exactly perpendicularly, and thereby consumes the energy of the shaped charge spike, so that it can no longer penetrate through the main armor inside the target. The effectiveness of such active armor leaves however still something to be desired. The same applies for the protection of such armor against fire. It also has the disadvantage in the same way as passive armor, thus conventional armor without such sandwich construction, that it is easily acquired by radar.

It is therefore the task of this invention to make available an active armor which provides protection against radar at the same time having a high degree of resistance against enemy fire.

SUMMARY OF THE INVENTION

The invention achieves this by the measures stated in the claims.

By providing radar absorbing materials in the external layer, the armor in the invention can no longer be seen by radar. The plastics binder furthermore entails a high degree of elongation and a low elastic modulus of the outer layer and thus provides a better protection against fire for the armor in the invention. At the same time the explosive material results in detonation of the outer layer and thus in an interference and a lethality reduction of the spike of the shaped charge. This means even if the external layer is directly applied to the main armor or a passive armor, an "active armor" is achieved.

The armor on which the external layer is arranged can thus be conventional active armor plate, thus the sandwich arrangement of an external thin layer from inert material, an explosives material layer and the main armor of the vehicle, or it can be passive armor plate, thus for instance an appropriately thick steel plate.

If the external layer is placed on a conventional active armor plate, the detonation of the external layer leads to the detonation of the explosive material layer of the conventional active armor.

In order to improve the adhesiveness of the external layer at a conventional active armor, thus a sandwich arrangement consisting of a layer of inert material, an explosive material layer and the main armor, the layer of inert material can be provided with penetrations or passages, so that a coherent matrix is formed between the external layer and the explosive material layer, into which the inert material layer is embedded. The explosive material layer herein has also a plastics material binder, preferably the same type as the external layer.

Preferably hydroxyl-or carboxyl-terminated polybutadiene (HTB or CTB), polybutadiene copolymer, such as PBAA or PBAN, polyurethane (PU) or silicon are used as a plastics material binder.

HTPB is especially suited not in the least because of its outstanding mechanical properties (high-elongation, low elastic modulus).

The quantity of the plastics material binder amounts preferably to 20% by weight at the most and, as a rule, to at least 5% by weight referring to the weight of the external layer. A content exceeding 20% by weight results generally in a considerable reduction of the explosive material content or of the radar absorbing materials, while a content below 5% by weight as a rule no longer yields satisfactory mechanical properties.

The thickness of the outer layer should not exceed 15 cm for practical reasons. The external layer herein can be constructed in the form of modules, thus plate shaped elements.

The external layer of the armor plate in the invention can be built up of several layers, wherein the outermost layer preferably consists only of radar absorbing materials and plastics material binder. This makes the external layer particularly weatherproof, meaning the explosive material in deeper layer or layers of the external layer is protected from atmospheric exposure.

The radar absorbing materials in the external layer of the armor plate in the invention are preferably carbon, for instance in the form of carbon black or carbon fibers, (wherein the lastly named ones increase the strength of the external layer), metal powder, such as aluminum powder or iron powder, especially carbonyl iron powder because of its small particle size, metal oxides such as titanium dioxide or highly dispersed silicic acid. Herein it is essential that the radar absorbing materials incorporated into the external layer of the invented armor plate are electrical conductors, thus that they have electrical and/or magnetic dissipation properties. The radar absorbing material must furthermore be in the form of particles, thus for instance powder-, fiber shaped or the like.

The shares of radar absorbing materials, referring to the weight of the external layer of the invented armor, should amount to at least a 10% by weight preferably to at least 20% by weight, wherein the maximum content of radar absorbing materials is predetermined by the consideration that the external layer must still contain sufficient explosive material so as to be able to detonate. As a rule, the upper limit of the content of radar absorbing materials should lie at approximately 50% by weight, referring to the total weight of the external layer.

The three components in the external layer of the inventive armor can for instance be present in the following ratios: 60 to 85% by weight of explosive material, 20 to 5% by weight plastics material binder, the rest being radar absorbing materials.

Generally the external layer of the inventive armor contains not only radar absorbing material, rather also several such materials, for instance carbon black, iron powder and titanium dioxide, in order to achieve an absorption of as many radar frequencies as possible.

A high explosive material, for instance octagen, hexogen or nitropenta is preferred as explosive material in the external layer of the inventive armor.

The external layer can also be foamed. Thus, an external layer with a polyurethane foam as binder and carbon black as radar absorbing material has been seen to provide particularly good protection against discovery by radar.

As mentioned, the external layer of the inventive armor can be built up from several layers or foils. The individual layers or foils herein preferably have different contents and possibly also different types of radar absorbing materials or different concentrations of explosive material. It is essential in such a sandwich arrangement of the external layer that all layers or foils have the same plastics material binder and the layers are simultaneously cured with each other while at the same time being adjacent in order to achieve as good an adhesiveness of the layers among themselves as possible.

The inventive armor plate can be utilized in battle tanks, but also for helicopters, fighters, ships and other such vehicles.

In the following the invention is described with particularity with the help of the attached drawing.

BRIEF DESCRIPTION OF THE INVENTION

DETAILED DESCRIPTION OF THE INVENTION

Figure 1:
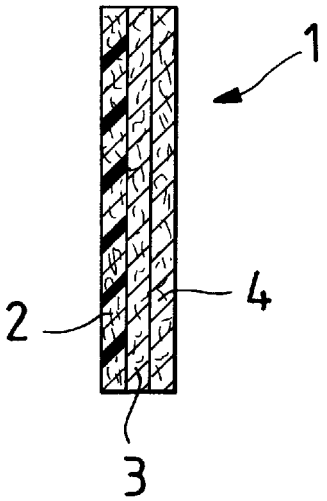
FIG. 1 is a sectional view of a module in accordance with a first embodiment form of the invention.

In FIG. 1 a plate shaped module 1 of the external layer of the inventive armor plate is depicted which consists of an outer layer 2, a middle layer 3 and an inner layer 4. The outer layer 2 consists herein for instance of 20 to 50% by weight of aluminum and/or carbon fibers and 50 to 80% by weight of plastics material binder, for instance HTPB. The central layer 3 is composed from 20 to 50% by weight of carbon fiber and/or titanium dioxide and 50 to 80% by weight of HTPB. The inner layer 4 consists of 90 to 95% by weight of explosive material, for instance nitropenta and 5 to 10% by weight of HTPB. The thicknesses of the layers amount herein respectively to 3 to 5 cm for the outermost layer 2, the central layer 3 and the innermost layer 4.

Figure 2:
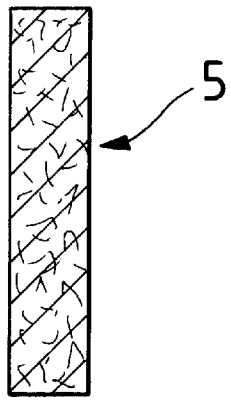
FIG. 2 is a sectional view of a module in accordance with an additional embodiment form.

According to FIG. 2 the plate shaped module 5 is structured in a homogeneous manner. It consists for instance of 65 to 70% by weight of explosive material, for instance nitropenta, 20 to 25% by weight of radar absorbing material, for instance carbon fiber as well as 5 to 10% by weight of plastics material binder. The layer thickness of the module 5 can, for instance amount to 10 cm.

Figure 3:
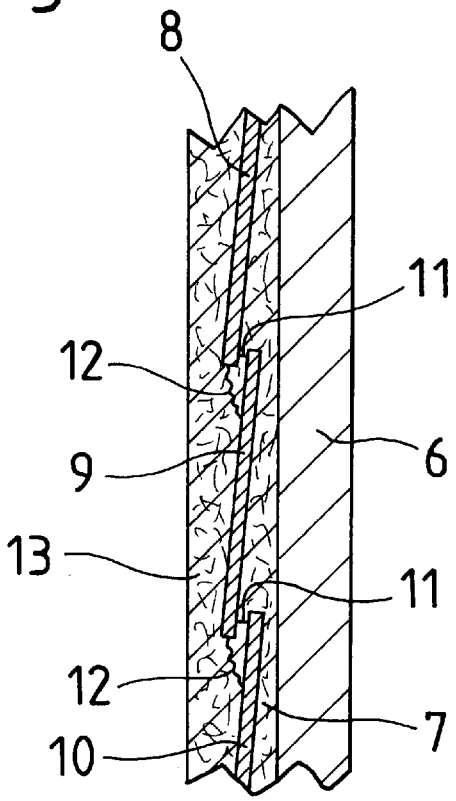
FIG. 3 is a sectional view of form of an embodiment form of the invention in which the external layer is arranged at an active armor.

In FIG. 3 an explosive material layer 7 is provided in front of a main armor 6 of steel. Plates 8, 9, 10 of an inert material, for instance, steel,are placed ahead of the explosive material layer 7. The plates 8, 9, 10 extend obliquely with respect to the main armor 6. They overlap each other and are spaced from each other by spacers 11 in the form of webs.

Thus passages are formed between the plates 8, 9, 10 through which the explosive material of the layer 7 can penetrate, as is indicated in FIG. 3 by the boundary layer 12. The outer layer 13 of the inventive armor plate follows adjacently to the boundary layer 12 and the plates 8, 9, 10. In order to achieve a high adhesiveness at the boundary layer 12, thus a common matrix of the external layer 13 and the explosive material layer 7 into which the plates 8, 9, 10 are embedded, the external layer 13 and the explosive material layer 7 incorporate the same or a similar plastics material binder.

In the external layer of the inventive armor plate, we are thus dealing with a composite material consisting of explosive material, radar absorbing materials and a plastics material matrix. The fabrication of the external layer is performed thus in the same manner as with plastics bound explosive materials. This means the radar absorbing materials and the plastics material binder are mixed with each other in a forced circulation mixer. The mixture is subsequently extruded into plates or foils and the plastics material binder is cured.

This means that in order to fabricate a radar absorbing foil for the external layer of the inventive armor plate, one can for instance use hydroxyl-terminated polybutadiene, as well as other common materials of plastics bound explosive materials, such as softeners and the like, whereupon the explosive material, for instance RDX or HMX and the radar absorbing materials are mixed in, and namely in a vacuum, in order to avoid bubbles. Subsequently, the vacuum is broken and stabilizers, catalyzers, fluxes and the like as well as an isocyanate hardener are added to the mixture. The mixture is then cast into a foil or calendered in the half hard state within the useful life adjustable by means of the recipe.

We claim:

1. Armor plate for vehicles comprises a plate shaped module having an exterior surface arranged to face outwardly from a vehicle and an interior surface to face toward the vehicle, said plate shaped module including an explosive material bound with a plastics material binder, a radar absorbing material bound with a plastics material binder, and the same said plastics material binder binding said explosive material and said radar absorbing material.

2. Armor plate, as set forth in claim 1, wherein said plastics material binder is selected from one of the group consisting of polybutadiene, a polybutadiene-copolymer, polyurethane or silicon.

3. Armor plate, as set forth in claims 1 or 2, wherein said radar absorbing material is selected from at least one of the group consisting of carbon, a metal and a metal oxide.

4. Armor plate, as set forth in claim 3, wherein said radar absorbing material comprises at least 10% by weight of the weight of said plate shaped module.

5. Armor plate, as set forth in claim 2, wherein said plastics material binder comprises 5 to 20% by weight of the weight of said plate shaped module.

6. Armor plate, as set forth in claim 1, wherein said plate shaped module is foamed.

7. Armor plate, as set forth in claim 1, wherein said plate shaped module comprises a plurality of layers including an outermost layer forming the exterior surface of said module and said outermost layer consisting of plastics material binder and said radar absorbing material.

8. Armor plate, as set forth in claim 1, wherein said plate shaped module is located on an armor plate comprising a thin layer of inert material joining said plate shaped module, an explosive material layer located between said thin layer and a main armor of the vehicle.

9. Armor plate, as set forth in claim 8, wherein said thin layer of inert material having openings therethrough communicating between said explosive material layer and said plate shaped module.

10. Armor plate, as set forth in claim 9, wherein said thin layer of inert material comprises plates overlapping one another and disposed in spaced relation forming said opening through said thin layer of inert material.

* * * * *